US005223363A

United States Patent [19]

Shozi

[11] Patent Number: 5,223,363

[45] Date of Patent: * Jun. 29, 1993

[54] METHOD OF MANUFACTURING ELECTRO-PHOTOGRAPHIC PHOTORECEPTOR

[75] Inventor: Hiromasa Shozi, Tokyo, Japan

[73] Assignee: Fuji Electric Co., Ltd., Japan

[ * ] Notice: The portion of the term of this patent subsequent to Jan. 14, 2009 has been disclaimed.

[21] Appl. No.: 310,535

[22] Filed: Feb. 13, 1989

[30] Foreign Application Priority Data

Feb. 16, 1988 [JP] Japan ..... 63-33475

[51] Int. Cl.[5] ..... G03G 15/04; G03G 5/00

[52] U.S. Cl. ..... 430/69; 430/127

[58] Field of Search ..... 430/127, 69; 427/327

[56] References Cited

U.S. PATENT DOCUMENTS

| | | | |
|---|---|---|---|
| 3,973,967 | 8/1976 | Lerner | 430/413 |
| 4,076,504 | 2/1978 | Fisher | 430/69 X |
| 4,134,763 | 1/1979 | Fujimura et al. | 430/69 |
| 4,514,483 | 4/1985 | Matsuura et al. | 430/84 |
| 4,654,285 | 3/1987 | Nishiguchi | 430/69 |
| 4,696,882 | 9/1987 | Saitoh et al. | 430/57 |
| 4,702,981 | 10/1987 | Matsumoto et al. | 430/69 |
| 4,929,524 | 5/1990 | Sakai et al. | 430/56 |
| 5,009,974 | 4/1991 | Honda et al. | 430/69 |
| 5,080,993 | 1/1992 | Maruta et al. | 430/69 |

FOREIGN PATENT DOCUMENTS

| | | | |
|---|---|---|---|
| 3261367 | 10/1988 | Japan | 430/69 |

OTHER PUBLICATIONS

"Japanese Industrial Standard: Definitions and Designation of Surface Roughness", JIS B0601, Japanese Standards Association (1983).

*Primary Examiner*—Marion E. McCamish
*Assistant Examiner*—S. Crossan
*Attorney, Agent, or Firm*—Brumbaugh, Graves, Donohue & Raymond

[57] ABSTRACT

Electrophotographic photoreceptors are made by the steps of cutting the surface of a cylindrical aluminum base such that the average surface roughness of 10 points is 0.5 to 1.0 μm and the waviness is not more than 0.4 μm; etching the surface of the base with nitric acid; and depositing a selenium-containing photoconductive material onto the surface of the base.

3 Claims, 2 Drawing Sheets

METHOD OF MANUFACTURING ELECTRO-PHOTOGRAPHIC PHOTORECEPTOR

BACKGROUND OF THE INVENTION

The present invention relates to a method of manufacturing an electrophotographic photoreceptor by depositing a photosensitive layer consisting of a selenium photoconductive material such as $As_2Se_3$ or an Se-Te alloy onto a cylindrical aluminum base in a vacuum.

In known methods of producing an electrophotographic photoreceptor, the surface of an aluminum base is ground with a cylindrical or rectangular parallelepiped grinding stone in order to make the surface uniform and enhance the adhesion between the surface and the photosensitive layer. Grinding the surface, however, gives rise to several problems. As shown in FIG. 2, dust 3 may adhere to the aluminum base 1, and when $As_2Se_3$ is deposited on the aluminum base 1, a protrusion 21 is produced on the surface of the deposition layer 2. A second problem occurs if an aluminum burr 4 is produced on the base 1, as shown in FIG. 3. Again a protrusion 21 is produced on the surface of the deposition layer 2. A third problem occurs if a flaw 5 is then produced on the base 1 due to the clogging of the grinding stone, as shown in FIG. 4, resulting in depression 22 in the deposition layer 2. These defects 21, 22 in the deposition layer 2 can cause pinholes in the photosensitive layer and a defect in the image produced, such as a white spot.

Accordingly, it is an object of the present invention to provide a method of manufacturing an electrophotographic photoreceptor which is capable of producing a stable aluminum base without grinding with a grindstone, thereby eliminating the above-described problems of the prior art, and which is capable of forming a flawless photosensitive layer by the deposition of a selenium material, thereby reducing defects in imaging.

SUMMARY OF THE INVENTION

To achieve this aim, the present invention provides a method of manufacturing an electrophotographic photoreceptor, comprising the steps of cutting the surface of a cylindrical aluminum base so that the average surface roughness of 10 points is 0.5 to 1.0 μm and the waviness is not more than 0.4 μm; etching the surface of the base with nitric acid; and depositing a selenium photoconductive material onto the surface of the base.

BRIEF DESCRIPTION OF THE DRAWINGS

FIG. 1(*b*) is a histogram showing the surface waviness of a photoreceptor prepared according to the claimed invention;

DETAILED DESCRIPTION OF THE INVENTION

A combination of cutting and chemical treatment enables the surface of an aluminum base to have good adhesion to the deposition layer and an appropriate roughness without the need for grinding with a grinding stone.

According to the present invention, after the surface of a cylindrical aluminum base is cut so that the average surface roughness of 10 points is 0.5 to 1.0 μm and the waviness is not more than 0.4 μm, an oxide film layer is formed on the surface by treatment with an $HNO_3$ solution, thereby producing a stable surface state. Consequently, it is possible to deposit a more uniform and stable Se-As photosensitive layer as compared with that deposited on a surface ground with a grinding stone to the same surface roughness and wariness. The fraction of defective electrophotographic photoreceptors prepared according to the claimed invention is reduced and the quality of images produced is improved, since grinding dust does not adhere to the surfaces of the aluminum bases, and aluminum burrs and surface flaws are not formed.

The following non-limiting example is intended to further illustrate the claimed invention.

EXAMPLE 34 samples were produced according to the following steps. An aluminum cylinder having a diameter of about 100 mm was mounted on a precision machining lathe, and cut with a diamond bit so that the average surface roughness, Rz, of 10 points was 0.5 to 1.0 μm and the waviness was not more than 0.4 μm. After cleaning the machined aluminum cylinder, it was immersed in an aqueous solution of 20 to 30% HNO for 10 to 15 minutes.

Figure 1A:
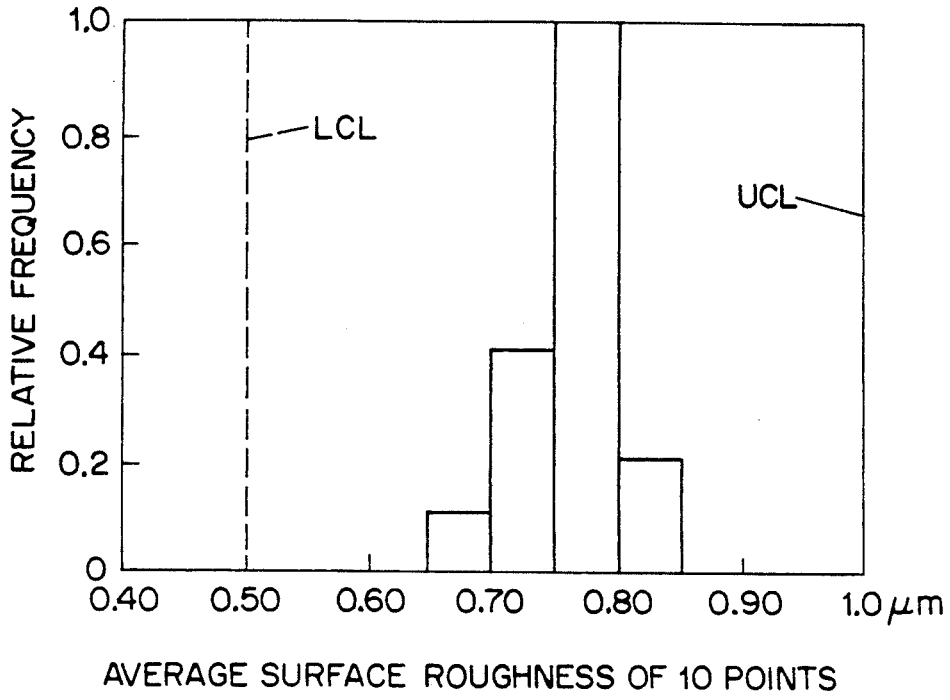
FIG. 1(*a*) is a histogram indicating the surface of a photoreceptor prepared according to the claimed invention has an average surface roughness of 10 points.
Figure 1B:
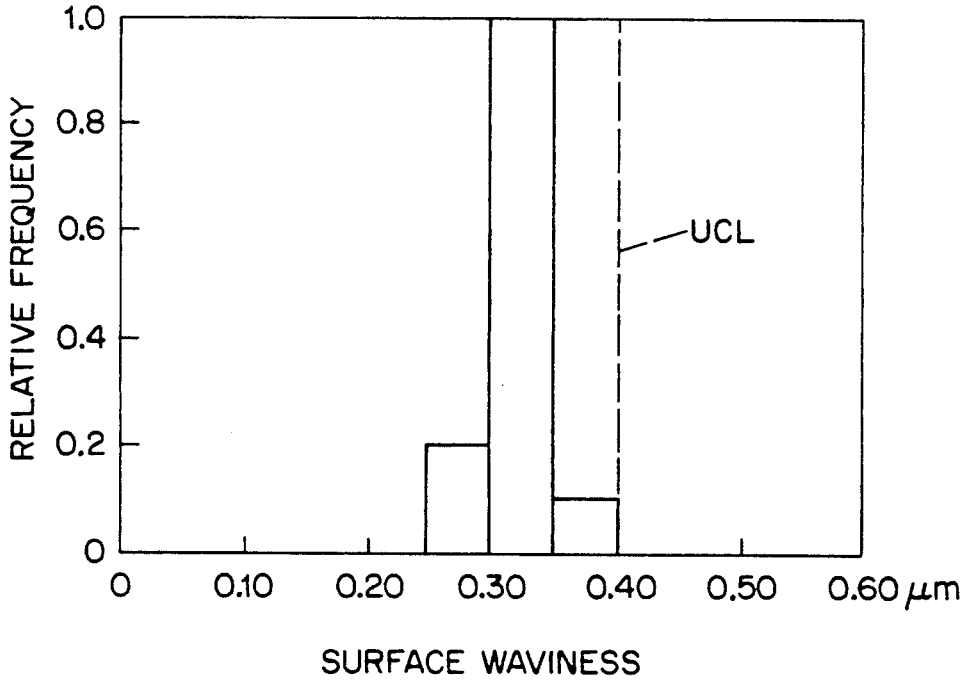
Figure 2:
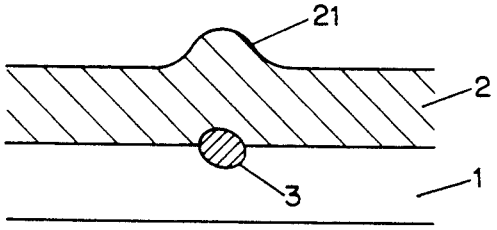
FIGS. 2, 3 and 4 are sectional views of the defects produced by the prior art method in which the surface is ground with a grinding stone.
Figure 3:
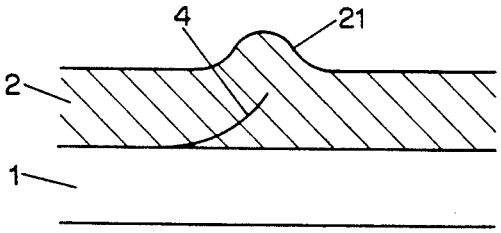
Figure 4:
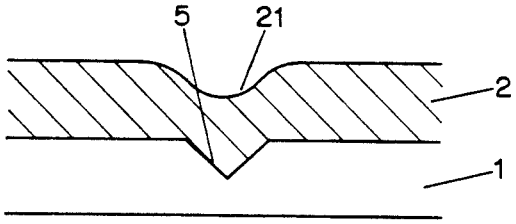
Figure 5:
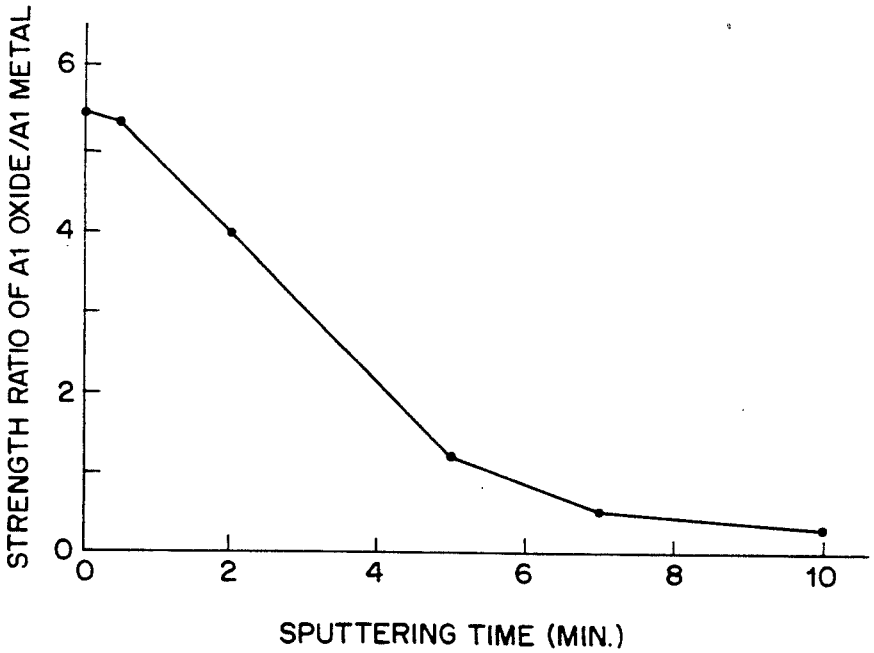
FIG. 5 is a graph showing the results of analysis by ESCA of the aluminum base after immersion in nitric acid.

The surface states of samples after immersion in $HNO_3$ are shown by the histograms in FIG. 1(*a*) and FIG. 1(*b*). FIG. 1(*a*) shows the surface roughness, and FIG. 1(*b*) shows the surface waviness. The average surface roughness, Rz, of the samples was 0.75 μm and the average surface waviness was 0.32 μm. The symbol LCL represents the lower control limit and UCL the upper control limit. The surface of the aluminum after immersion in $HNO_3$ solution was analyzed by ESCA. The results are shown in FIG. 5. The ordinate represents the strength ratio of aluminum oxide/aluminum metal, and the abscissa represents sputtering time. FIG. 5 shows that an oxide film is formed on the surface. After subjecting the aluminum base to the above-described surface treatment, an $As_2Se_3$ photosensitive layer was deposited on the surface.

Table 1 shows a comparison of prior art photoreceptors and photoreceptors prepared according to the claimed method for percent defective due to white spots in the image produced and pinholes. The surface roughness and waviness were set at the same levels for each group of photoreceptors. The fraction of defective photoreceptors produced according to the claimed method was approximately half of the fraction of defective photoreceptors produced according to the prior art method.

TABLE 1

| | Prior Art | Invention |
|---|---|---|
| White spot in image | 15% | 8% |
| Pinhole | 7% | 4% |

I claim:

1. A method of manufacturing an electrophotographic photoreceptor, comprising: (a) cutting the surface of a cylindrical aluminum base with a diamond bit, without grinding with a grindstone such that the average surface roughness of 10 points is 0.5 to 1.0 μm and the waviness is not more than 0.4 μm; (b) etching the surface of said base with nitric acid; and (c) depositing a selenium-containing photoconductive material selected from the group consisting of selenium arsenic alloys, selenium-tellurium alloys, and pure selenium onto the surface of said base.

2. The method according to claim 1, wherein the nitric acid is in an aqueous solution of 20 to 30% nitric acid.

3. The method according to claim 1, wherein the photoconductive material is $As_2Se_3$.

* * * * *

UNITED STATES PATENT AND TRADEMARK OFFICE

CERTIFICATE OF CORRECTION

PATENT NO. : 5,223,363

DATED : June 29, 1993

INVENTOR(S) : Hiromasa Shozi

It is certified that error appears in the above-identified patent and that said Letters Patent is hereby corrected as shown below:

Column 2, line 32, "HNO" should read --$HNO_3$--;

Column 2, following TABLE 1, insert --Such a reduction in fraction defective is also obtained in the case of depositing other Se-As alloys, Se-Te alloys or pure Se.--.

Signed and Sealed this

Fifth Day of April, 1994

Bruce Lehman

BRUCE LEHMAN

*Commissioner of Patents and Trademarks*

*Attest:*

*Attesting Officer*